US009837777B1

(12) United States Patent
Blake et al.

(10) Patent No.: US 9,837,777 B1
(45) Date of Patent: Dec. 5, 2017

(54) EXPANDABLE CABLE CONNECTOR TORQUE ADAPTER

(71) Applicant: Steren Electronics International, LLC, San Diego, CA (US)

(72) Inventors: Joshua Blake, San Diego, CA (US); Brandon Clark, San Diego, CA (US)

(73) Assignee: Steren Electronics International, LLC, San Diego, CA (US)

( * ) Notice: Subject to any disclaimer, the term of this patent is extended or adjusted under 35 U.S.C. 154(b) by 0 days.

(21) Appl. No.: 15/252,027

(22) Filed: Aug. 30, 2016

(51) Int. Cl.

| | |
|---|---|
| ***H01R 43/26*** | (2006.01) |
| ***H01R 24/38*** | (2011.01) |
| ***B25B 13/48*** | (2006.01) |
| ***B25B 13/10*** | (2006.01) |
| *B25B 13/04* | (2006.01) |
| *B25B 13/52* | (2006.01) |

(52) U.S. Cl.
CPC ..... *H01R 43/26* (2013.01); *B25B 13/10* (2013.01); *B25B 13/48* (2013.01); *H01R 24/38* (2013.01); *B25B 13/04* (2013.01); *B25B 13/52* (2013.01)

(58) Field of Classification Search
CPC ..... H01R 43/26; H01R 24/38; B25B 13/10; B25B 13/48; B25B 13/52; B25B 27/0042; B25B 13/04
USPC ..... 81/64, 65, 459, 452, 448, 57.34, 57.36
See application file for complete search history.

(56) References Cited

U.S. PATENT DOCUMENTS 1,092,574 A * 4/1914 Jansson ..... F16D 7/048 464/37
3,212,050 A 10/1965 Stark
4,662,703 A * 5/1987 Forney, Jr. ..... H01R 13/41 439/578
4,730,385 A 3/1988 Ryan et al.
4,854,893 A 8/1989 Morris
5,297,458 A 3/1994 Smith et al.
5,316,348 A 5/1994 Franklin
5,367,925 A 11/1994 Gasparre et al.
5,435,745 A * 7/1995 Booth ..... H01R 9/0521 439/583
5,572,912 A 11/1996 Gasparre
5,857,711 A 1/1999 Dumong
6,034,325 A 3/2000 Nattel et al.
D460,739 S 7/2002 Fox
D460,740 S 7/2002 Montena
D460,946 S 7/2002 Montena
D460,947 S 7/2002 Montena
6,716,062 B1 4/2004 Palinkas et al.
6,767,247 B2 7/2004 Rodrigues
(Continued)

OTHER PUBLICATIONS

"EZT Installed", Thomas & Betts Corporation, Apr. 2009, 1 page.

*Primary Examiner* — Larry E Waggle, Jr.
*Assistant Examiner* — Danny Hong
(74) *Attorney, Agent, or Firm* — ARC IP Law, PC; Joseph J. Mayo

(57) ABSTRACT

Torque adapter for a cable connector that expands to fit connector nuts of different sizes. The adapter fits around the cable connector and engages three of the corners of a hex nut with matching recessed regions in its inner surface. It has three slots that receive the other three corners of the connector nut. The adapter is flexible so that the slots may widen to accommodate connector nuts of larger widths. The outer surface may be hexagonal so that a wrench or similar tool may be used to turn the torque adapter.

8 Claims, 5 Drawing Sheets

(56) References Cited

U.S. PATENT DOCUMENTS

| | | | | |
|---|---|---|---|---|
| 6,817,272 | B2 | 11/2004 | Holland | |
| 6,887,102 | B1 | 5/2005 | Burris et al. | |
| 6,971,912 | B2 | 12/2005 | Montena | |
| 7,014,501 | B2 | 3/2006 | Montena | |
| 7,052,283 | B2 * | 5/2006 | Pixley | H01R 24/42 336/92 |
| 7,097,500 | B2 | 8/2006 | Montena | |
| 7,128,603 | B2 | 10/2006 | Burris et al. | |
| 7,147,509 | B1 | 12/2006 | Burris et al. | |
| 7,219,582 | B2 | 5/2007 | Ito | |
| 7,226,300 | B2 | 6/2007 | Khemakhem | |
| 7,311,555 | B1 | 12/2007 | Burris et al. | |
| 7,329,149 | B2 | 2/2008 | Montena | |
| 7,347,129 | B1 * | 3/2008 | Youtsey | B25B 13/06 81/124.2 |
| 7,364,462 | B2 | 4/2008 | Holland | |
| 7,413,693 | B2 | 8/2008 | Goacher | |
| 7,452,237 | B1 | 11/2008 | Montena | |
| 7,544,094 | B1 | 6/2009 | Paglia | |
| 7,837,501 | B2 * | 11/2010 | Youtsey | H01R 24/40 439/445 |
| 8,490,525 | B2 * | 7/2013 | Wilson | B25B 13/06 81/467 |
| 2004/0194585 | A1 | 10/2004 | Clark | |
| 2006/0266166 | A1 | 11/2006 | Weber | |
| 2008/0318469 | A1 | 12/2008 | Paglia et al. | |
| 2009/0163076 | A1 | 6/2009 | Paglia et al. | |
| 2011/0059650 | A1 * | 3/2011 | Amidon | H01R 13/623 439/584 |
| 2013/0005180 | A1 * | 1/2013 | Malloy | H01R 9/0524 439/578 |
| 2014/0027173 | A1 * | 1/2014 | Clothier | H02G 3/0691 174/665 |

* cited by examiner

Section A-A

Section A-A with Hex Nut

EXPANDABLE CABLE CONNECTOR TORQUE ADAPTER

BACKGROUND OF THE INVENTION

Field of the Invention

One or more embodiments of the invention are related to the field of cable connectors. More particularly, but not by way of limitation, one or more embodiments of the invention enable a torque adapter that fits around a cable connector to aid in connecting or disconnecting the cable, and that expands to fit cable connector nuts of various sizes.

Description of the Related Art

Coaxial cables are usually terminated with Radio Frequency (RF) type connectors for attaching the cable to a device. Some RF connectors are gold or rhodium plated, while others use silver, or nickel or tin plating. Mechanically, RF connectors provide a fastening mechanism (thread, bayonet, braces, or push pull are common) and springs to ensure a low resistance electric contact between the cable and the connection port on the target device. Threaded connectors, such as Type-F connectors, typically comprise a nut used to draw the connector into a secure attachment to the connection port of the device. Typically, the cable is inserted into the connector, then the nut is rotated until the connector is well seated in the device port, and the nut holds the cable firmly attached even if the device is moved. A firm seating of the connector to the port is required to prevent signal loss, decrease noise and in the case of outdoor applications to prevent water and other corrosives from invading the cable.

While coaxial cable connector nuts may be rotated by hand, using a tightening tool, such as a wrench or pliers, to tighten the nut is preferred to obtain the desired tight seal. Standard coaxial cables require a wrench to be utilized to rotate the threaded end extent, or nut, of the coaxial cable to securely attach the coaxial connector on, or detach off of, a coaxial cable port, for example on a cable set top box or DVD player. Hand tightening is generally not sufficient to insure that a secure, tight connection is achieved between the coaxial connector and the coaxial cable port. The result of an insecure connection is generally increased noise and/or signal loss. It is difficult and potentially dangerous to use a wrench tightening tool in hard to reach areas and or on components very close to near electric sources such as outlets.

Various tools exist to facilitate proper tightening of coaxial cable connector nuts. For example, a tight plastic tube fitting that extends over the nut of the coaxial connector to facilitate hand tightening is known. Known solutions generally provide a torque aid that fixedly engages the nut and requires one torque aid for each coaxial connector.

Other apparatus, such as torque wrenches, are known that overlay the coaxial connector nut, either from the conductor side or port side, thereby trapping a torque wrench, or fixedly attached between the nut and the collar of the coaxial connector, again fixedly attaching the torque wrench to the coaxial connector. Some known solutions require a torque wrench to be removed from the coaxial connector by breaking fins off the outside of the torque wrench. These types of connectors may be dangerous if the small circular wrench itself or fins detached from the wrench are later swallowed by a child or pet, for example.

Yet another apparatus, called a wrench sleeve, is known. Often made of soft rubber or plastic, a wrench sleeve is used on threaded plumbing connectors such as those found on a garden hose. The wrench sleeve slides up to cover the nut of the threaded connector, providing a large surface area to allow a more comfortable and secure grip of nut of when unscrewing the connector. An illustrative wrench sleeve for cable connectors is described in U.S. Utility Pat. No. 9,124,046, "Coaxial cable connector sleeve."

A limitation of existing tools and aids for attaching connectors is that they are designed to fit connectors with nuts of a single specific size. Cable connectors have nuts of various sizes. There are no known torque adapters that fit a range of connectors with different nut sizes.

For at least the limitations described above there is a need for an expandable cable connector torque adapter.

BRIEF SUMMARY OF THE INVENTION

One or more embodiments described in the specification are related to an expandable cable connector torque adapter. Embodiments of the system fit around a cable connector nut and facilitate rotation of the nut to connect or disconnect the cable. Embodiments of the system provide an expandable inner surface that engages the connector nut, so that a single torque adapter may be used with connectors having nuts of different sizes.

One or more embodiments of the adapter may have a tubular form with an open center bore into which a cable connector is inserted. The adapter may have a front end that engages with a hex nut (or nut of any shape) of the connector, and a back end opposite the front end that may surround the cable jacket, for example. The longitudinal axis of the adapter runs along the center of the bore. The inner surface of the adapter may have three recessed regions to receive and engage with three corresponding corners of a hex nut. The adapter may also have three slots starting at the front end, and parallel to the longitudinal axis, to receive the other three corners of a hex nut. Each slot may be opposite one of the three recessed regions. The portions of the adapter between the slots may be configured to bend radially away from the longitudinal axis when a force is applied to the inner surface. This bending may widen the slots, thereby allowing the adapter to accommodate a larger hex nut. In one or more embodiments the bending may be achieved by using a flexible material for all or part of the torque adapter. For example, the adapter may be made of a plastic such as ABS (acrylonitrile butadiene styrene).

In one or more embodiments the outer surface of the adapter may have a hexagonal shape, for example to accommodate a wrench or another tool. In one or more embodiments the outer surface may have a knurling, for example to facilitate gripping and hand tightening.

One or more embodiments may be configured to fit any type of cable connector, including for example, without limitation an F-type coaxial cable connector. One or more embodiments may accommodate connectors with nuts of any desired size, including for example, without limitation, nuts with diameters in the range of 7/16 inches to 5/8 inches.

BRIEF DESCRIPTION OF THE DRAWINGS

The above and other aspects, features and advantages of the invention will be more apparent from the following more particular description thereof, presented in conjunction with the following drawings wherein.

DETAILED DESCRIPTION OF THE INVENTION

An expandable cable connector torque adapter will now be described. In the following exemplary description numerous specific details are set forth in order to provide a more thorough understanding of embodiments of the invention. It will be apparent, however, to an artisan of ordinary skill that the present invention may be practiced without incorporating all aspects of the specific details described herein. In other instances, specific features, quantities, or measurements well known to those of ordinary skill in the art have not been described in detail so as not to obscure the invention. Readers should note that although examples of the invention are set forth herein, the claims, and the full scope of any equivalents, are what define the metes and bounds of the invention.

Figure 1:
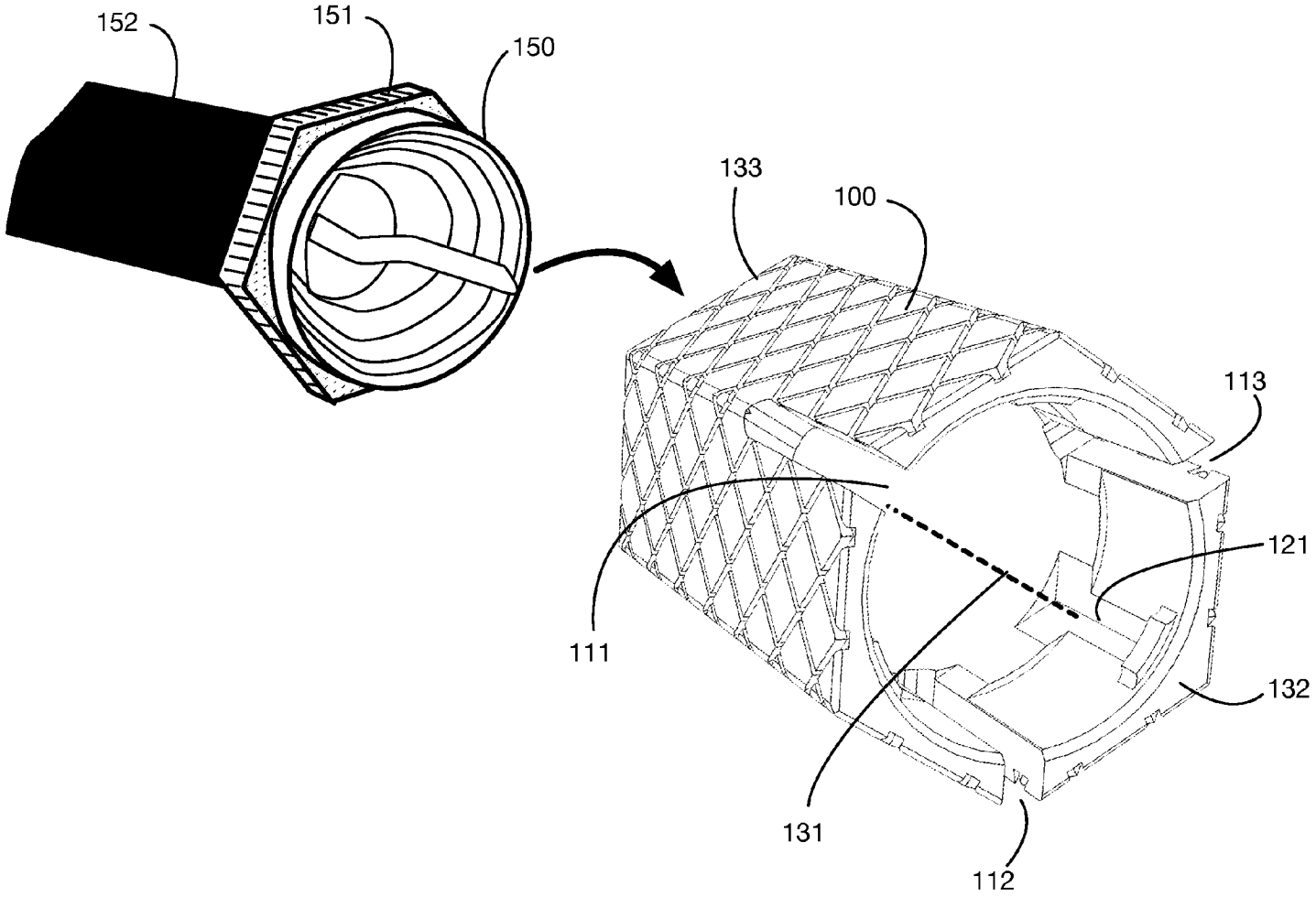
FIG. 1 shows a perspective view of an embodiment of the torque adapter, and shows an illustrative cable connector that fits into the interior of the adapter.

FIG. 1 shows an illustrative embodiment of an expandable cable connector torque adapter. Torque adapter 100 fits around cable connector 150 that terminates cable 152. One or more embodiments may be configured to fit around any type of cable connector for any type of cable, including but not limited to coaxial cable. Cable connector 150 has a nut 151 that is rotated to attach the connector to a mating connection. The illustrative nut 151 is hexagonal. The embodiments described below are configured for hexagonal nuts; however, one or more embodiments may be configured to adapt to nuts of any shape.

Torque adapter 100 is substantially tubular in shape, with a center bore into which connector 150 fits. The adapter has a front end 132 that engages the nut 151 of the connector, and a back end 133 that surrounds but does not grip the cable 152. For reference, longitudinal axis 131 lies along the center of the bore running between the back end 133 and the front end 132. The inner surface of the adapter is configured to engage the hexagonal nut 151. This inner surface has three recessed regions that match three non-adjacent corners of hexagonal nut 151. In FIG. 1 only one of these three regions, 121, is visible; the others are shown in FIGS. 2A, 2C, and 2D. Recessed region 121 shown has two planar surfaces that meet at an angle of approximately 120 degrees, so that it mates with a corner of hexagonal nut 151. Adapter 100 also has three slots 111, 112, and 113 starting at front end 132 and parallel to the longitudinal axis 131. Each slot is radially opposite one of the recessed regions; for example, slot 111 is opposite recessed region 121. When connector 150 is inserted into the adapter 100, three of the corners of the hex nut 151 fit into the slots 111, 112, and 113, and the other three corners fit into the recessed regions such as 121.

The torque adapter embodiment 100 illustrated in FIG. 1 has a hexagonal outer surface. This hexagonal shape may for example facilitate turning of the torque adapter using a wrench or other tool. This shape is illustrative; one or more embodiments may have any desired shape for the outer surface of the torque adapter. The embodiment of FIG. 1 also has a knurled outer surface to facilitate gripping and hand tightening. This knurling is illustrative; one or more embodiments may have any finish or pattern on the outer surface. One or more embodiments may use a compliant material on the outer surface or for the entire torque adapter to facilitate gripping and turning.

Figure 2B:
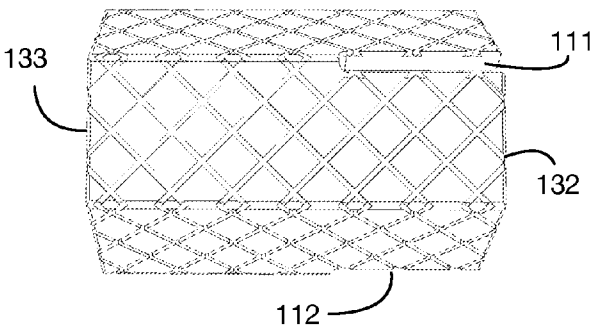
FIG. 2B shows a side view of the embodiment of FIG. 1.
Figure 2D:
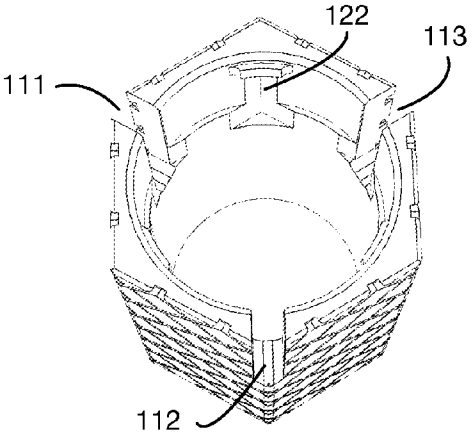
FIG. 2D shows a view from the front of the embodiment of FIG. 1 with the torque adapter tilted up to show the upper inner surfaces.
Figure 2A:
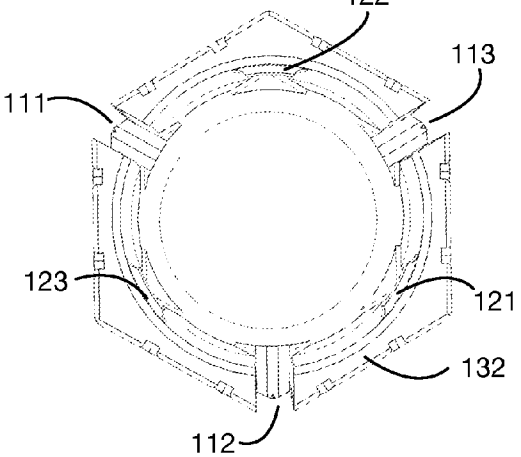
FIG. 2A shows a front view of the embodiment of FIG. 1.
Figure 2C:
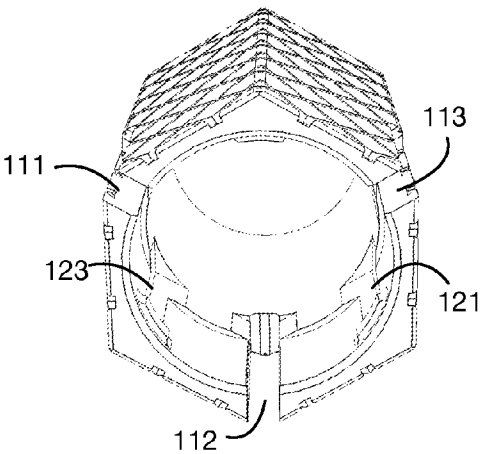
FIG. 2C shows a view from the front of the embodiment of FIG. 1 with the torque adapter tilted down to show the lower inner surfaces.

FIGS. 2A-2D show several views of the torque adapter of FIG. 1 from various angles. FIG. 2A shows the adapter from the front end 132, looking along the longitudinal axis. The three recessed regions 121, 122 and 123 are visible; these recessed regions are opposite slots 111, 112, and 113, respectively. FIG. 2B shows a side view of the adapter. FIG. 2C shows the adapter from the front tilted down slightly to show details of recessed regions 121 and 123; FIG. 2D shows the adapter from the front tilted up slightly to show details of recessed region 122.

Figure 3A:
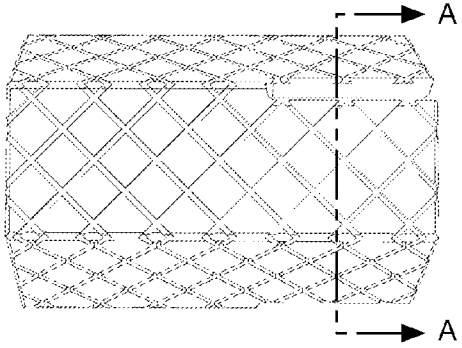
FIG. 3A shows a side view of the embodiment of FIG. 1, indicating a cutting plane for the cross sectional views of FIGS. 3B and 3C.
Figure 3B:
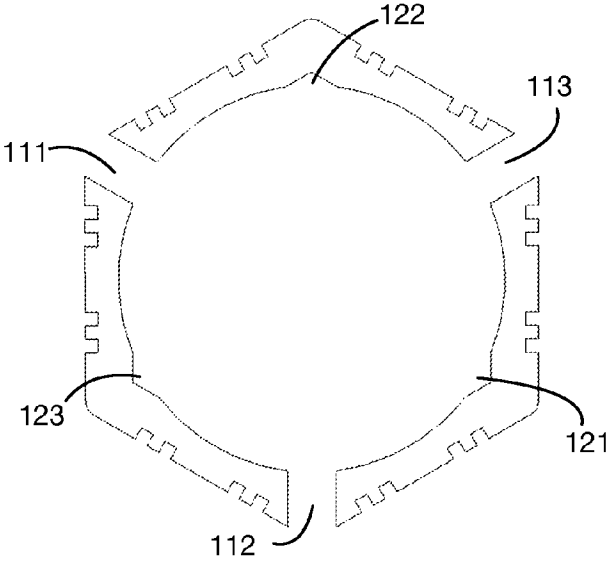
FIG. 3B shows a cross sectional view of the embodiment of FIG. 1, which illustrates the slots and the recessed regions in the inner surface that receive the corners of a connector's hex nut.
Figure 3C:
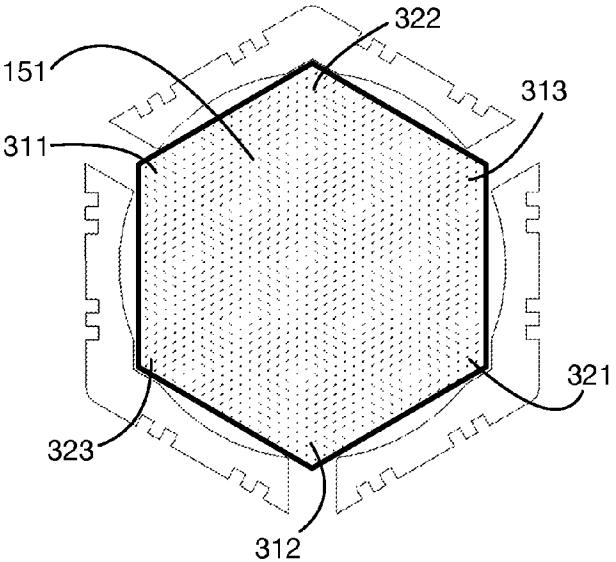
FIG. 3C shows the cross sectional view of FIG. 3B with a hex nut inserted into the torque adapter.

FIGS. 3B-3C show a cross sectional view of the adapter along a cutting plane A-A near the front end of FIG. 3A that is perpendicular to the longitudinal axis. In FIG. 3B the gaps for slots 111, 112, and 113 are shown, as are the recessed areas 121, 122 and 123. FIG. 3C shows an illustrative hex nut 151 installed into the adapter. Corners 311, 312, and 313 of the hex nut lie within the gaps of slots 111, 112, and 113, respectively. The other three corners 321, 322, and 323 of the hex nut engage with the recessed regions 121, 122, and 123, respectively.

Figure 4:
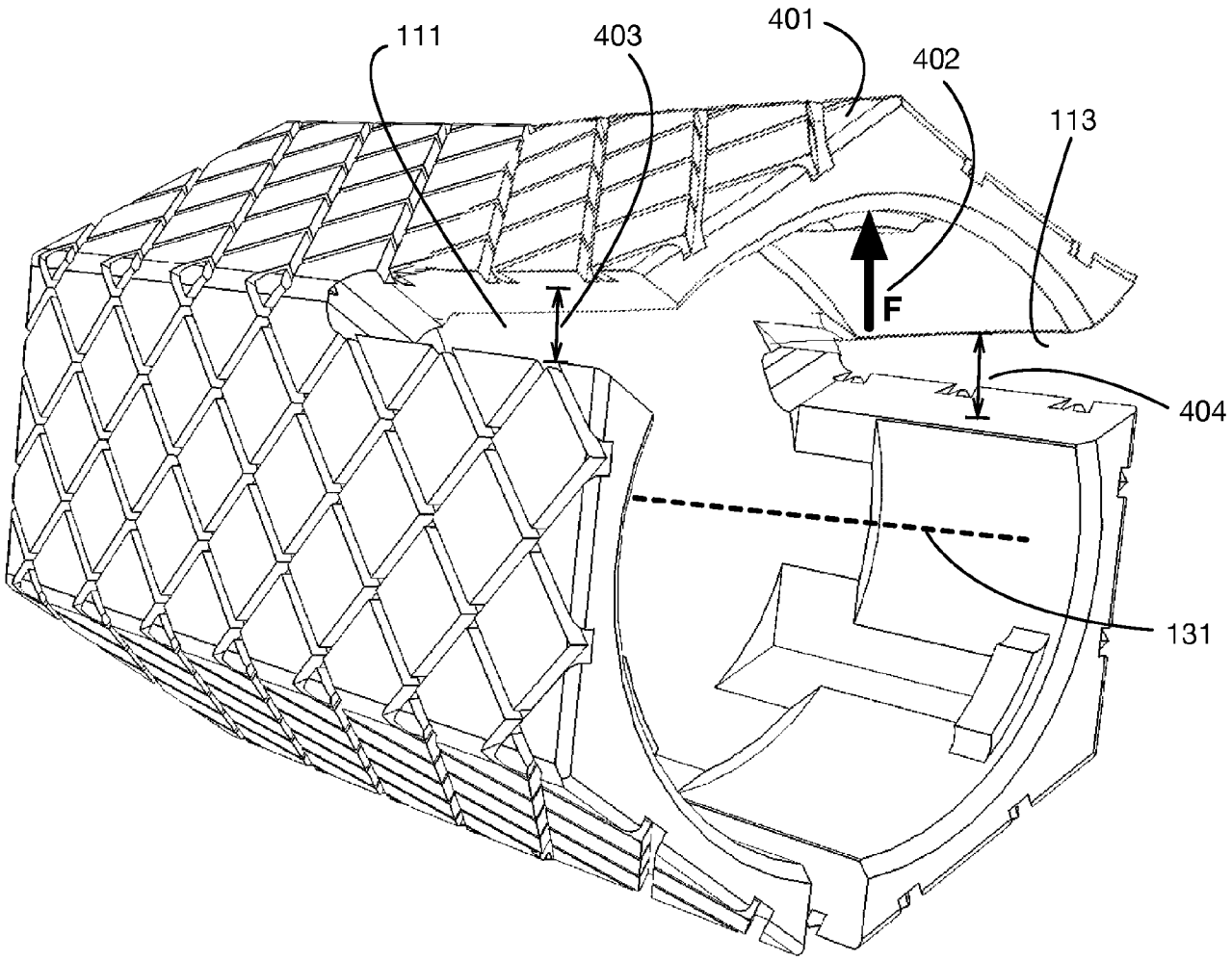
FIG. 4 shows how an embodiment of the system expands when a cable connector nut exerts a radial force against the inner surface of the torque adapter.

In one or more embodiments the front portion of the adapter is flexible so that the portions of the adapter between the slots can bend away from the longitudinal axis. This bending may allow the adapter to accommodate hex nuts of different sizes. FIG. 4 illustrates the bending that widens the slots. A force 402 is applied to the inner surface of the adapter in a region between slots 111 and 113. This force causes the portion 401 of the adapter between these slots to bend radially away from longitudinal axis 131. As a result, the width of slot 111 increases to 403, and the width of slot 113 increases to 404. Similar bending may occur with the other two portions of the adapter between the other pairs of slots. In one or more embodiments the bending of the adapter may be a function of the material used to construct the adapter. For example, one or more embodiments may be constructed all or in part from plastic or rubber or another flexible material. One or more embodiments may be made entirely or in part of ABS (acrylonitrile butadiene styrene), for example.

Figure 5B:
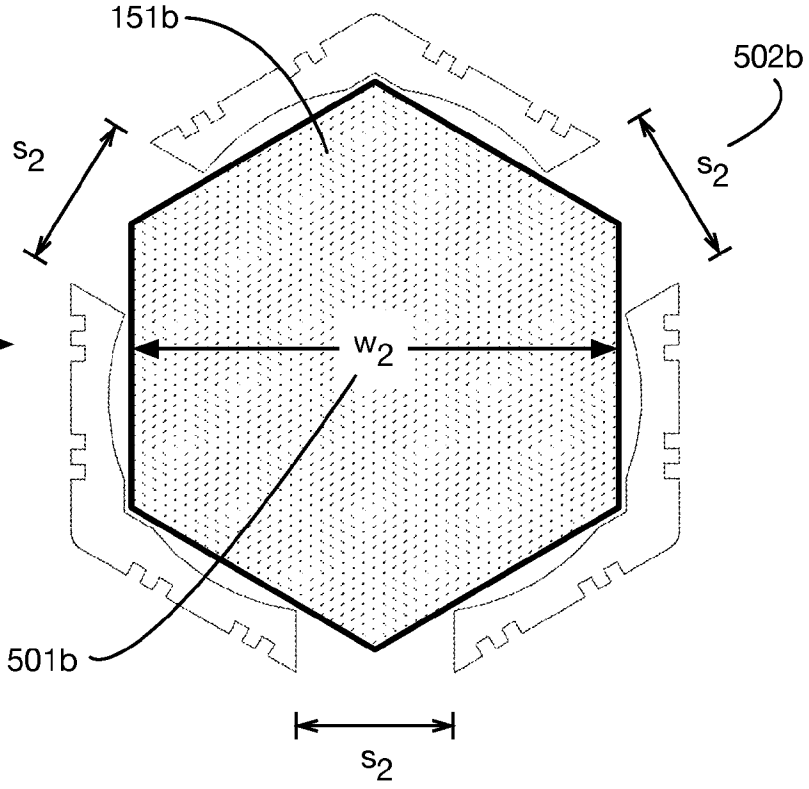
FIG. 5B shows a cross sectional view of the torque adapter with a larger nut, showing how the torque adapter expands to accommodate the larger nut.
Figure 5A:
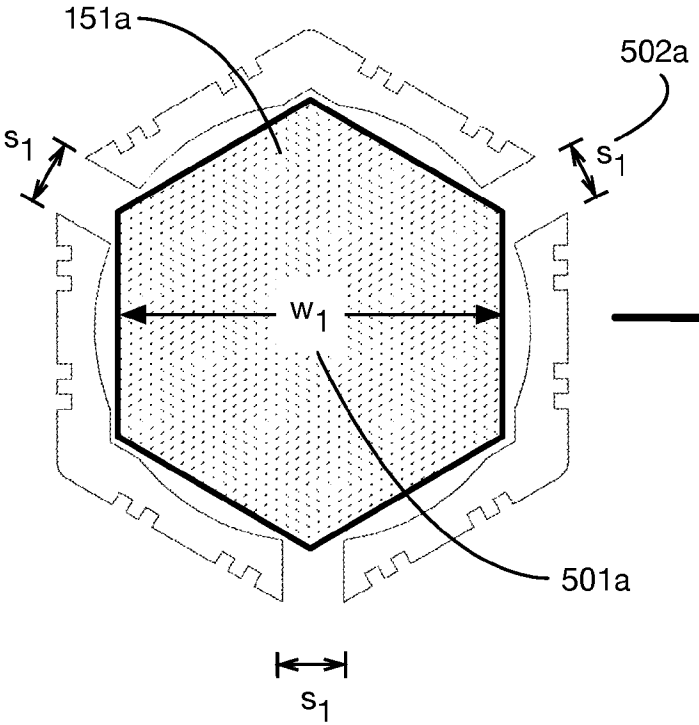
FIG. 5A shows a cross sectional view of the torque adapter with a smaller nut.

FIGS. 5A-5B illustrate the expansion of one or more embodiments of the adapter due to the bending and widening of the slots, using a cross sectional view. In FIG. 5A, the adapter accommodates a hex nut 151*a* that has a width 501*a*. The adapter may for example be in an equilibrium (unbent)

configuration, with slot widths 502*a*. In FIG. 5B, a larger hex nut 151*b* with width 501*b* is inserted into the adapter. The hex nut applies force to the inner surface of the adapter, resulting in outward bending as illustrated in FIG. 4. The slot widths expand from baseline width 502*a* to expanded width 502*b* to accommodate the larger hex nut. For example, without limitation, the smaller hex nut 151*a* may have a width 501*a* of 7/16 inches, and the larger hex nut 151*b* may have a width 501*b* of 5/8 inches. These widths are illustrative; one or more embodiments may accommodate any desired range of nut sizes.

While the invention herein disclosed has been described by means of specific embodiments and applications thereof, numerous modifications and variations could be made thereto by those skilled in the art without departing from the scope of the invention set forth in the claims.

What is claimed is:

1. An expandable cable connector torque adapter comprising: a tubular element configured to fit detachably around a cable connector having a hexagonal nut, said tubular element having a front end that engages said hexagonal nut and that is flexible; a back end opposite to said front end; a longitudinal axis along a center of said tubular element, said longitudinal axis extending between said back end and said front end; three portions, wherein each portion of said three portions comprises an expandable inner surface; three recessed regions, wherein each recessed region is in a corresponding expandable inner surface of each of said three portions is proximal to said front end, and is located and shaped to engage a corresponding corner of three non-adjacent corners of said hexagonal nut; and, three slots, wherein each slot of said three slots begins at said front end; is parallel to said longitudinal axis is radially opposite to one of said three recessed regions; is located between each pair of said three portions; is located and shaped to engage a corresponding corner of three remaining corners of said hexagonal nut, wherein a vertex of said corresponding corner of said hexagonal nut lies within said slot; wherein said three portions are continuously radially connected at said back end; and wherein each portion of said three portions is configured to bend radially away from said longitudinal axis when a force is applied to a region of said expandable inner surface of said portion, thereby expanding a width of each of said adjacent slots at said front end to widen said three slots from a first baseline width to an expanded width, and thereby increasing a diameter of said hexagonal nut that engages with said front end of said tubular element configured to allow said tubular element to accommodate hexagonal nuts of different sizes.

2. The expandable cable connector torque adapter of claim 1, wherein an outer surface of said tubular element has a hexagonal cross section with a cutting plane perpendicular to said longitudinal axis.

3. The expandable cable connector torque adapter of claim 1, wherein said tubular element has a knurling on its outer surface.

4. The expandable cable connector torque adapter of claim 1, wherein said tubular element comprises ABS plastic.

5. The expandable cable connector torque adapter of claim 1, wherein said tubular element fits detachably around an F-type coaxial cable connector.

6. The expandable cable connector torque adapter of claim 1, wherein said tubular element fits detachably around a cable connector having a hex nut with a diameter between 7/16 inches and 5/8 inches.

7. An expandable cable connector torque adapter comprising: a tubular element configured to fit detachably around a cable connector having a hexagonal nut, said tubular element having a front end that engages said hexagonal nut and that is flexible; a back end opposite to said front end; a longitudinal axis along a center of said tubular element, said longitudinal axis extending between said back end and said front end; three portions, wherein each portion of said three portions comprises an expandable inner surface; three recessed regions, wherein each recessed region is in a corresponding expandable inner surface of said three portions; is proximal to said front end; and, is located and shaped to engage a corresponding corner of three non-adjacent corners of said hexagonal nut; and, three slots, wherein each slot of said three slots begins at said front end; is parallel to said longitudinal axis; is radially opposite to one of said three recessed regions; and, is located and shaped to engage a corresponding corner of three remaining corners of said hexagonal nut, wherein a vertex of said corner of said hexagonal nut lies within said slot; wherein said three portions are continuously radially connected at said back end; wherein each portion of said three portions is configured to bend radially away from said longitudinal axis when a force is applied to a region of said expandable inner surface of said portion, thereby expanding a width of each of said adjacent slots at said front end to widen said three slots from a first baseline width to an expanded width, and thereby increasing a diameter of said hexagonal nut that engages with said front end of said tubular element configured to avow said tubular element to accommodate hexagonal nuts or different sizes; wherein an outer surface of said tubular element has a hexagonal cross section with a cutting plane perpendicular to said longitudinal axis; wherein said tubular element has a knurling on its outer surface; wherein said tubular element comprises ABS plastic; wherein said tubular element fits detachably around an F-type coaxial cable connector; and, wherein said tubular element fits detachably around a cable connector having a hex nut with a diameter between 7/16 inches and 5/8 inches.

8. The expandable cable connector torque adapter of claim 1, wherein each of said three recessed regions comprises two planar surfaces that meet at an angle of approximately 120 degrees such that each of said three recessed regions mate with said corresponding corner of said three non-adjacent corners of said hexagonal nut.

* * * * *